US005309653A

United States Patent [19]

Pease et al.

[11] Patent Number: 5,309,653

[45] Date of Patent: May 10, 1994

[54] SNOW DEFLECTION SYSTEM

[75] Inventors: Walter G. Pease; Michael J. Collins, both of Barnes; Arthur J. Smith, Gordon, all of Wis.

[73] Assignee: Snow Visions, Inc., Solon Springs, Wis.

[21] Appl. No.: 986,174

[22] Filed: Dec. 4, 1992

Related U.S. Application Data

[63] Continuation-in-part of Ser. No. 885,802, May 12, 1992, abandoned, which is a continuation-in-part of Ser. No. 514,912, Apr. 16, 1990, abandoned.

[51] Int. Cl.[5] ..... E01H 5/06

[52] U.S. Cl. ..... 37/266; 37/275; 37/903; 180/68.1

[58] Field of Search ..... 37/266, 270, 271, 260, 37/279, 281, 275, 280, DIG. 12; 180/68.1

[56] References Cited

U.S. PATENT DOCUMENTS

| | | | |
|---|---|---|---|
| 1,684,439 | 9/1928 | Flowers | 37/275 |
| 1,900,703 | 3/1933 | Frink | 37/275 |
| 1,926,011 | 9/1933 | Soule | 37/275 |
| 2,085,996 | 7/1937 | Phillips | 37/260 |
| 2,103,775 | 12/1937 | Frink | 37/270 |
| 2,160,973 | 6/1939 | Litchy | 37/275 |
| 2,904,904 | 9/1959 | Krueger | 37/275 |
| 3,115,715 | 12/1963 | Baldwin | 37/260 |
| 3,432,947 | 3/1969 | Peitl | 37/275 |
| 4,459,769 | 7/1984 | Willis, Sr. | 37/275 |
| 4,587,750 | 5/1986 | Larson | 37/266 |
| 4,669,205 | 6/1987 | Smathers | 37/232 |
| 4,896,915 | 1/1990 | Morandi et al. | 180/68.1 |
| 5,048,207 | 9/1991 | Verseef | 37/279 |
| 5,155,929 | 10/1992 | Vachon | 37/266 |

FOREIGN PATENT DOCUMENTS

| | | | |
|---|---|---|---|
| 194427 | 1/1958 | Fed. Rep. of Germany | 37/232 |
| 3316699 | 3/1984 | Fed. Rep. of Germany | 37/232 |
| 3736707 | 5/1989 | Fed. Rep. of Germany | 37/266 |
| 34289 | 3/1965 | Finland | 37/266 |
| 1164361 | 6/1985 | U.S.S.R. | 37/266 |
| 624211 | 5/1949 | United Kingdom | 37/271 |

OTHER PUBLICATIONS

Good Roads Machinery Corp. Brochure, p. 19, Dec. 1940.

*Primary Examiner*—Randolph A. Reese
*Assistant Examiner*—Spencer Warnick
*Attorney, Agent, or Firm*—Wheeler Law Firm

[57] ABSTRACT

A snow deflection system for a snowplow includes an arcuate foil and a preferred belt. Both the foil and the belt are attached to the moldboard of the plow so that the preferred belt keeps the plowed snow close enough to the moldboard to allow the arcuate foil to direct the flow of snow and air, which blows over the top of the moldboard, down and away from the plow vehicle.

5 Claims, 2 Drawing Sheets

SNOW DEFLECTION SYSTEM

This is a continuation-in-part of U.S. patent application Ser. No. 07/885,802, filed on May 12, 1992, now abandoned, which was a continuation-in-part of U.S. patent parent application Ser. No. 07/514,912 which was filed on Apr. 16, 1990, now abandoned.

BACKGROUND OF THE INVENTION

The present invention relates to the field of snowplows, specifically, to the use of visors or foils which would reduce and control the blowing of snow up over the upper edge of the moldboard of the plow. Such snow may strike the windshield of the plow, the body of the plow vehicle, and strike or enter into the engine of the plow vehicle. This causes obstruction of the view of the driver of the vehicle, damage to the body of the plow vehicle and impairment of the vehicle's engine performance.

In a normal snowplow, without a snow deflector system, snow may come up over the top of the snowplow and ultimately cause a vision problem for the driver both from the snow blown in the path of his vision and the snow impacting on the windshield. Also, the snow can be drawn into the engine causing impairment of engine performance or even damage to the engine itself. Further, in areas where sand and/or salt is put on the road to help increase traction and melt ice and snow, the sand or salt has a tendency to mix with the snow, salt, and sand can cause a sandblasting effect upon the body of the vehicle thereby significantly reducing the life of the body of the vehicle by removing the paint from the vehicle and exposing the bare metal surface of the vehicle to direct contact with the snow and road salt.

There have been many attempts to solve this problem but none resolve it as simply and effectively as the design of the instant invention.

For example U.S. Pat. No. 2,385,996 (Phillips) discloses a snow flow deflector. However, unlike the instant invention Phillips shows the leading edge of its deflector to be at or below the upper edge of the moldboard. This is completely contrary to the structure of the instant invention. Further, the design of Phillips allows its deflector to tip back, as a safety feature, when large drifts are encountered. This eliminates the effectiveness of the Phillips device in those situations. Also, the angle iron 5 disclosed in FIGS. 1–3 and structures 40, 1, and 41 of the alternative design disclosed in FIG. 6 of Phillips, all create choke points which will impede the flow of snow under the deflector causing a blockage which would render the deflector inoperative. Additionally, Phillips discloses no belt or barrier structure for partially containing the flow of snow particles as they are pushed out in front of the moldboard. The final alternative structure disclosed in FIG. 7 of Phillips is completely different in structure from the instant invention. U.S. Pat. No. 3,432,947 (Peitl), is also structurally and conceptually different from the instant invention. Peitl does not disclose the use of the belt barrier that is hung from the top edge of the moldboard in the instant invention. Further, the concept of the instant invention is to provide a foil which provides minimum resistance to the flow of snow and air that passes through and over it. The steep angle of orientation taught in Peitl (" . . . said deflector having top and bottom edges, a forward surface and a back surface"; claim 1, U.S. Pat. No. 3,432,947 (Peitl)) provides greater resistance to air flow than the instant invention having leading and trailing edges and top and bottom surfaces and therefore is counter to the design of the instant invention. The design of the Peitl deflector is such that it does not in truth direct any air or snow into the space between his deflector B and the back side of the blade A because the air and snow mixture, upon leaving contact with the upper edge 31 of the blade continues forward in the direction that the vehicle is moving past the opening through which Peitl intends the snow to go through. There is so much dense snow moving in an upward direction that no air or snow can possibly change direction to get into the space that Peitl wishes it to go. The faster the vehicle moves forward the higher into the air the snow is thrown. This renders the deflector of Peitl useless. Peitl located his deflector (referred to as number 30 in his FIGS. 1 & 2) behind the flow of air/snow coming over the moldboard. Peitl's FIG. 2, depicts the flow of air/snow in relationship to a standard moldboard being operated at a very low speed. This is apparent because the snow is not flowing over the top of the moldboard. When operating at normal speeds, the air is compressed in front of the moldboard, it can escape only out the delivery end of the plow or over the top of the moldboard. The design of the standard moldboard picks up the snow and hurls it upward and slightly toward the delivery end of the plow. At the point the snow/air loses contact with the top of the moldboard it is traveling in the direction dictated by the shape of the moldboard, much the same as a bullet is aimed by the barrel of a gun. In this case, it will continue traveling on a tangent to the arc of the moldboard; its velocity will be that of the plowing vehicle. Therefore, in FIG. 2 of Peitl's patent, it is easy to see the air/snow will pass in front of and over his deflector when traveling at normal operating speeds disproving the arrows in his FIG. 2. The intake of the Peitl system as depicted in his FIG. 2, shows a large opening between the top of the moldboard and the leading edge of the deflector. However, the outlet of the system has a very small opening between the trailing edge of the deflector and the moldboard. This makes the passage of air and snow through the Peitl system, in the volumes required to be effective, impossible. His system of a venturi is completely contrary to the design of the present invention. The leading edge of the foil of the present invention is normally placed in a position eight (8) to twelve (12) inches above the top margin of the moldboard with the front edge and back edge being located in the same plane. The air just in front of the moldboard is highly compressed by the forward movement of the plow vehicle. This pressure is equalized by air escaping out the delivery end of the moldboard and over its top margin. This results in air traveling in a near vertical direction at a very high velocity from ground level up and passing just in front of the belt. The concave shape of the foil placed above this vertically traveling air gently re-directs it over and down behind the moldboard, without impeding its flow, unlike teachings in prior art. The top surface of the foil works similar to the top surface of an airplane wing. In an airplane wing the distance over the entire top of the foil from the front edge to the back edge is longer than the distance, in the same plane, from the front edge to the back edge on the under side. This faster moving top air joins at the back edge of the foil with the air already moving in a downwardly direction to help force all the air at the back edge of the foil in a downwardly direction behind the moldboard. The snow particles from in front and in back of the moldboard are caught in this air flow and are forced down to the ground directly behind the moldboard and under the vehicle. Patent DE 3736-707-A (Beil) depicts a device which is ridged in design, mounted on the top of a moldboard which has very small pressure relief ports between the device and the moldboard. For the most part this device equates to what is normally referred to as a belt in the United States. The ports are so small they restrict the air flow but allow air/snow to escape without the velocity or guidance to direct it down and under the plow vehicle. Other references include U.S. Pat. No. 1,900,703 (Frink), U.S. Pat. No. 1,926,071 (Soule), U.S. Pat. No. 2,904,904 (Krueger), and U.S. Pat. No. 4,459,769 (Willis). None of these references disclose either the use of the barrier belt or the use of a snow deflector which allows the flow of air and snow rising over the top edge of the moldboard to be deflected behind the back side of the moldboard and underneath the snowplow vehicle.

The main objective of the instant invention is to capture and control snow that rises over the top edge of the moldboard of the snowplow.

It is an advantage of the instant invention to allow plowing at high speed, this leaves the road in better, cleaner condition. It is a further advantage of the instant invention that the airflow directed behind the moldboard and under the vehicle prevents any snow or other particulate matter that may pass under the moldboard from being blown toward the vehicle. This is because the airflow from the foil at the top of the moldboard blows the particles coming from under the plow, down and away from the body of the vehicle and the engine of the vehicle.

SUMMARY OF THE INVENTION

The instant invention is to be built into or attached to a snowplow for the purpose of capturing and controlling the snow particles coming over the top of a snowplow vehicle's moldboard. An arcuate foil is located above the moldboard at a preselected distance according to the size and shape of the plow. A belt is attached to the top margin of the moldboard. The front edge of the foil is projected forward and above the top margin of the moldboard. The foil directs the snow particles and air from an upward direction to a downward direction as the snow particles and air are passing over and through the foil.

Also, the instant invention prevents or reduces the amount of dust, snow and other debris that is normally present between the front end of the snowplow vehicle and the back side of the moldboard from being blown into the plow vehicle. In a conventional snowplow reduced pressure is created at the back side of the moldboard as the plow vehicle moves along a road. This causes suction. The greater the speed the greater the suction. This suction normally causes debris immediately behind the moldboard to be lifted off the ground and blown into the vehicle. The instant invention, by providing a downward flow of air between the moldboard and the vehicle, prevents this from happening.

Many variables affect the amount of snow that is blown over the top of the moldboard, the speed at which the vehicle is being driven, the water content of the snow, the depth of the snow, and the size and shape of the moldboard. These variables can work together to overpower even the most advanced known snow deflecting system. However, the instant invention, by means of a unique and simple design, combines the use of the above described foil with a belt or other barrier means hung from the top of the moldboard. The belt knocks down the snow that is pushed up the moldboard thereby keeping the snow lower to the ground and in a closer relationship to the moldboard than other prior art systems. This allows the foil, which has one edge well out in front of the top margin of the moldboard, to easily capture and control the snow particles. As air combines with snow and other particulate matter in front of the moldboard it travels in an upward direction and the front edge of the foil catches the mixture and, with minimal interference, directs it back and down toward the ground behind the moldboard underneath the snowplow vehicle. This results in either no snow or a significantly reduced amount of snow obstructing the vision of the plow vehicle driver, improves the efficiency and safety of operation of the snowplow, and lengthens the life of the snowplow vehicle.

Although the belt is common knowledge in the art of snowplows, and the inventors do not intend or expect to patent the belt, both the belt and foil in the described relationship, are preferred to conform to the invention and achieve the desired result.

These and other benefits of the instant invention, the snow foil, will be apparent to one skilled in the art from the following description.

DETAILED DESCRIPTION

Figure 1:
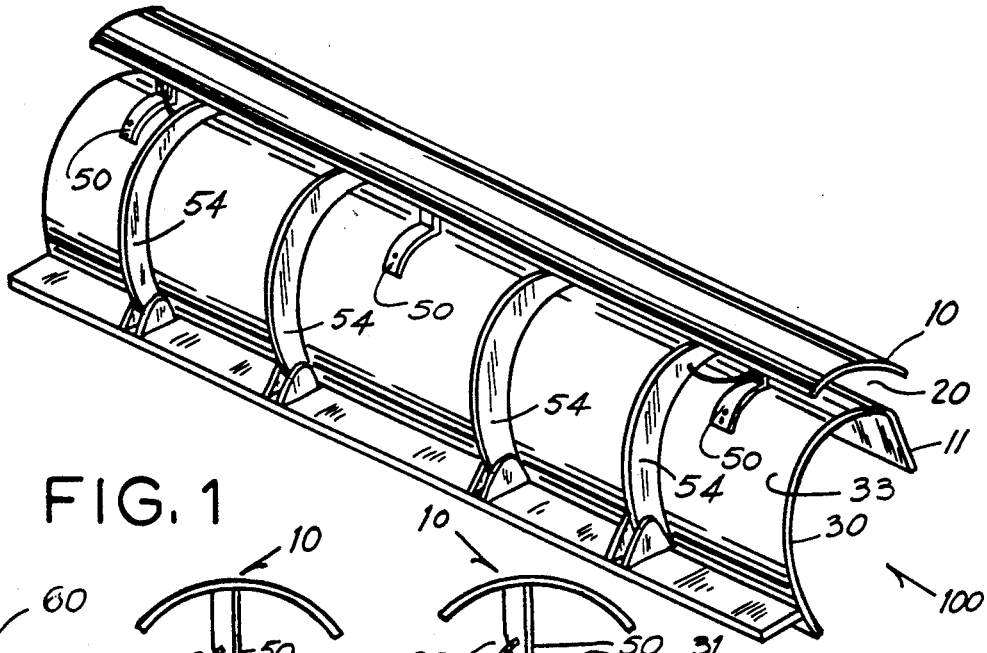
FIG. 1 is a perspective view.

Although the disclosure hereof is detailed and exact to enable those skilled in the art to practice the invention, the snow foil, the physical embodiments herein disclosed merely exemplify the invention which may be embodied in other specific structure. While the preferred embodiment has been described, the details may be changed without departing from the invention, the snow foil, which is defined by the claims.

The word "belt" herein refers either to a belt added to the upper margin of a moldboard, or to one integral with the upper edge of the moldboard. The word "snow" as it has been used in this description and in the following claims means, in addition to its common meaning, a mixture of snow, air, and other matter; e.g. salt or sand.

The instant invention is a snow foil system 99 comprising an arcuate foil 10 and a preferred belt 11. Please see FIGS. 5 and 3. The system is attached to the moldboard 30 of a snowplow vehicle 60. The moldboard 30 comprises a generally arcuate shaped body having a top margin 31, a bottom edge 32, a back side 33, and a front side 34. The back side 33 is generally convex and the front side 34 is generally concave. The moldboard 30 may also have a pair of skids 40 which prevent the bottom edge 32 from scraping or cutting into the road bed when the plow is in use. Please see FIG. 4.

Figure 3:
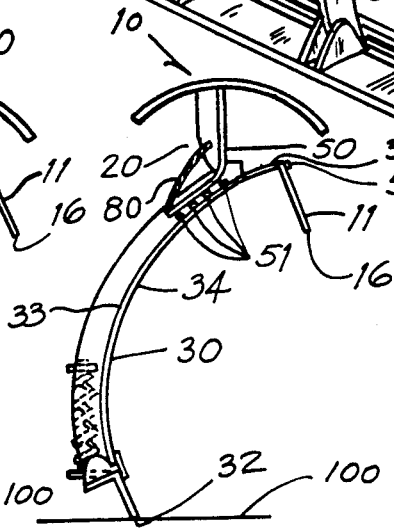
FIG. 3 is a side elevational view of the invention disclosed herein.
Figure 4:
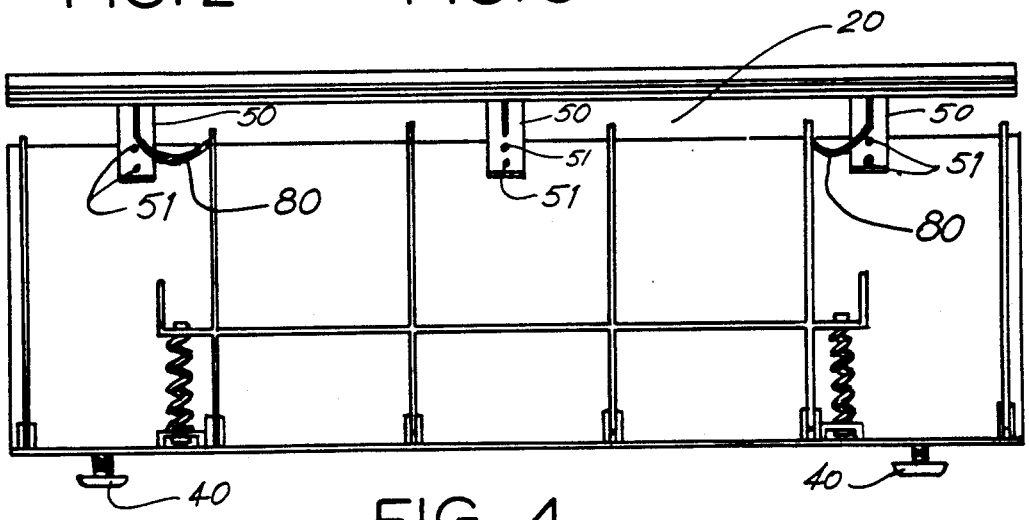
FIG. 4 is a rear elevational view of the moldboard and the snow foil.
Figure 5:
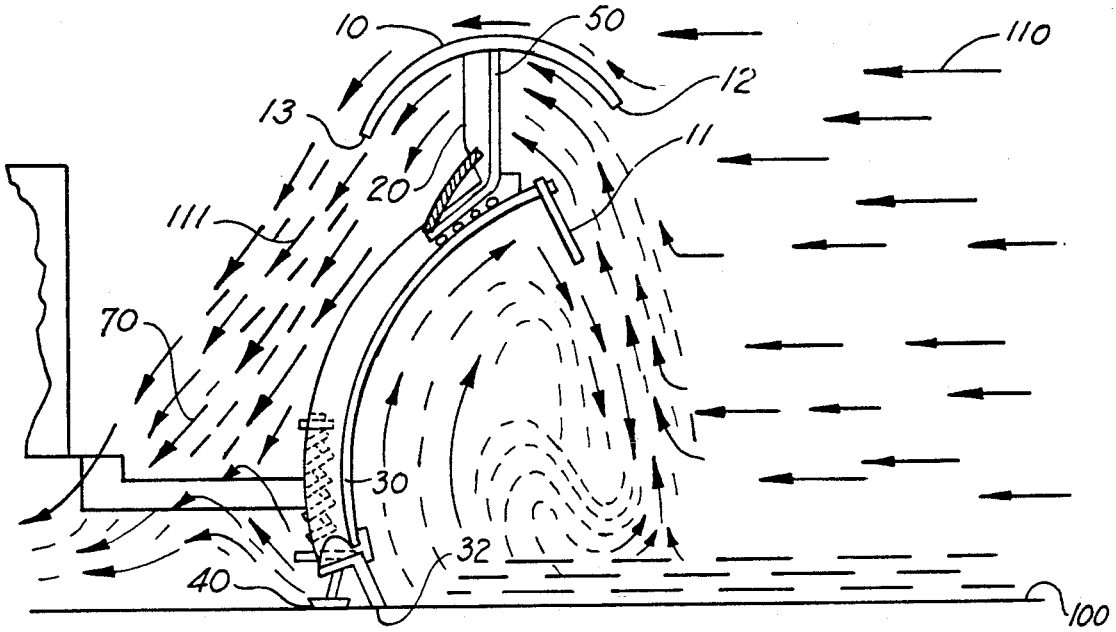
FIG. 5 is a side elevational view of the present invention.

Referring to FIG. 5 it may be seen that in the preferred form of the invention the foil 10 is attached to the back side 33 of the moldboard 30 by struts 50 and bolts 51. The preferred belt 11, if not already an integral part of moldboard 30, is attached to the top margin 31 of the moldboard 30 by bolts 52. FIG. 3. Many other attachment means will, of course, be apparent to those skilled in the art. For example, the foil 10 could be attached to the ribs 54 of the moldboard 30. See FIG. 1. Further, the struts 50 could be welded or use other means of permanent attachment to moldboard 30. A safety cable 80 is attached to the foil 10 to keep it with the moldboard 30 in the unlikely event it should break free from its mounting. This prevents the foil 10 from being blown into the plow vehicle 60; e.g. in an accident.

The struts 50 are attached to both the moldboard 30 and the foil 10. The struts 50 are positioned so that the front edge 12, of the foil 10, extends out beyond and above the top margin 31, of the moldboard 30. FIGS. 3 and 5. The positioning and size of the struts 50 is designed to prevent the development of choke points. FIGS. 1-5. This creates space 20, which must be of sufficient size to insure minimum resistance to air flow. The air flow space seldom exceeds twelve (12) inches or is less than eight (8) inches. The downward arc of the back edge 13 is sufficient to create a downward flow of snow which passes over the top margin 31 of the moldboard 30, while at the same time allowing the foil 10 to present minimal resistance through space 20. FIGS. 1-5. This creates a smooth airflow path 70. FIG. 2 and 5. In other words the system of the snow foil, provides a path of least resistance for the snow particles down and away from the plow vehicle.

In other words, the front edge 12 of the foil 10 and back edge 13 of the foil 10 are parallel to each other and to the ground 100 so that the back edge 13 is the same distance from the ground 100 as the front edge 12. Also, the back edge 13 extends substantially behind the top margin 31 of the moldboard 30. Accordingly, a wing like foil 10 having no choke points is produced.

Figure 6:
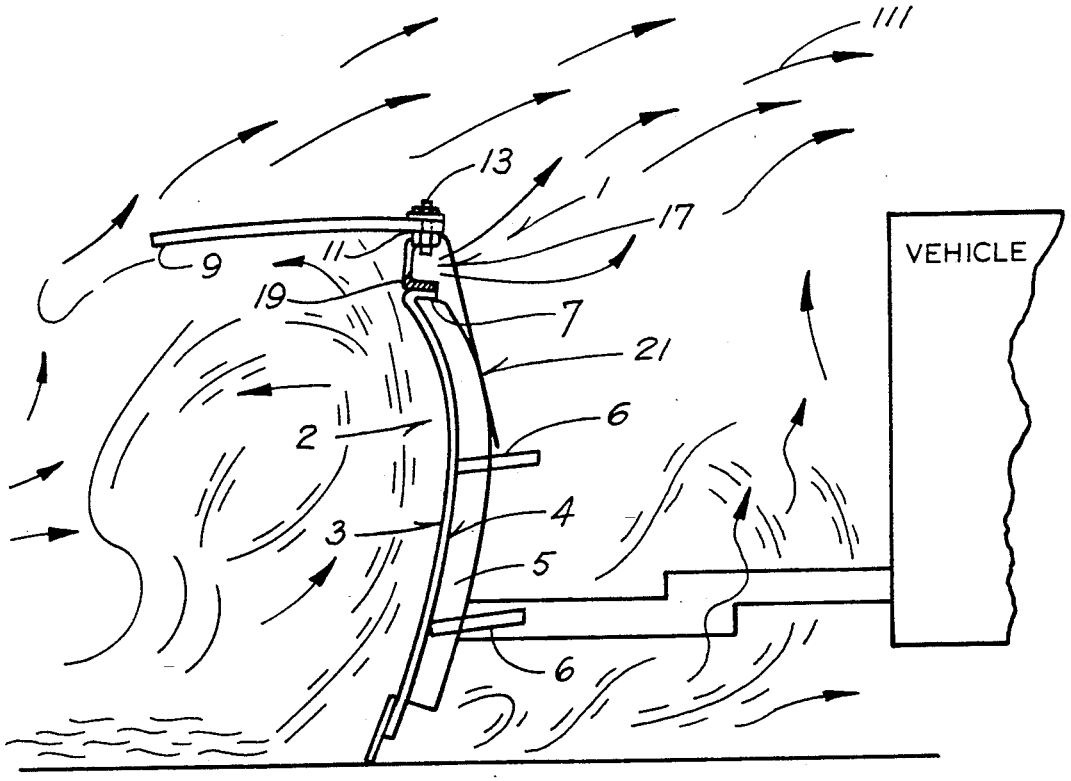
FIG. 6 PRIOR ART
FIG. 6 is a side view of the prior art disclosed in German Patent DE3736-707-A (Beil) and illustrating the actual function of that design which equates to a large belt commonly used in the United States.

The overall effect is one of dramatically increased effectiveness as is shown in FIGS. 5-6. Referring to FIG. 5 the movement of air may be seen by the arrows 110 and the mixture of snow and air by the arrows 111. As may be seen by comparison with FIG. 6 showing a prior art type device, the snow and air mixture does not overpower the present invention because the design of the present invention creates a flow path that presents little or no impediment to the mixture of snow and air while the prior art tends to create flow paths that push the snow and air mixture into an undesirable flow path.

The preferred belt 11 knocks down any snow that builds up near the top margin 31 of the moldboard 30. This keeps the snow closer to the front side 34 of the moldboard 30, even at high speeds.

Figure 2:
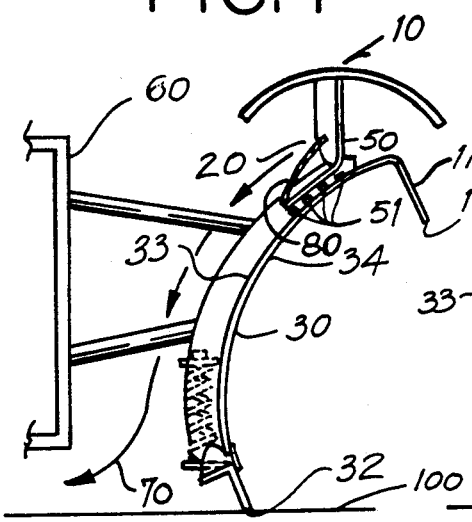
FIG. 2 is a side elevational view of alternative structure for invention disclosed in that the only difference between the structure of the alternate embodiment and that of the instant invention, the snow foil, is that the "belt" is made integral with the structure of the moldboard 30.

Also, as FIG. 1 shows, when the structure of the belt 11 is made integral with the structure of the moldboard 30, then one structure with the same function as the previously described combination of moldboard 30 and preferred belt 11 exists. This is true even though the integral belt 11 is usually substantially more rigid than the separate belt 11.

The above described embodiments of this invention are merely descriptive of its principles and are not to be limiting. The scope of this invention instead shall be determined from the scope of the following claims, including their equivalents. Based upon this disclosure, the structure of the snow foil may be made adjustable in many various ways that will be apparent to those skilled in the art by moving forward or backward, up or down, as long as the plane created by a line from the leading edge to the trailing edge of the foil is reasonably parallel to the ground and high enough to allow choke free escape of all air. Proper positioning of the foil guarantees the system cannot be overpowered by speed of operation or snow condition.

What is claimed is:

1. On a snowplow vehicle for plowing snow having a moldboard with a top margin the combination comprising:

arcuate foil means attached to said moldboard for controlling generally all of the flow of said snow above said moldboard;

belt means permanently attached to said top margin of said moldboard and extending downwardly from said moldboard for controlling and maintaining the position of generally all of said snow in generally close proximity with said moldboard;

said arcuate foil means and said top margin of said moldboard defining an airflow space of approximately eight to twelve inches;

whereby said belt means keeps said snow close enough to said moldboard to allow said foil means to effectively direct said snow downwardly away from said snowplow vehicle.

2. On a snowplow vehicle for plowing snow having a generally arcuate moldboard with a top margin combination comprising:

a generally arcuate foil for controlling the flow of said snow over said moldboard;

belt means permanently attached to said top margin of said moldboard and extending downwardly from said moldboard for controlling and maintaining the position of generally all of said snow in generally close proximity with said moldboard;

said arcuate foil being mounted above said moldboard and having a front edge and a back edge parallel to each other and parallel to the ground so that the front edge is the same distance from the ground as the back edge;

said arcuate foil and said top margin of said moldboard defining an airflow space of approximately eight inches to twelve inches;

said belt means also having a top edge attached to said top margin of said moldboard.

3. The combination of claim 1 in which said arcuate foil has a front edge and a back edge:

said front edge and said back edge being located in the same plane;

said plane being above said moldboard and generally parallel to the ground.

4. The combination of claim 2 wherein:

said belt means has a bottom edge;

said front edge of said arcuate foil being located above said top edge of said belt means.

5. On a snowplow vehicle for plowing snow on the ground, having a moldboard with a top margin, the combination comprising:

arcuate foil means, attached to said moldboard, for controlling the flow of said snow above said moldboard;

belt means, attached to said top margin of said moldboard and extending downwardly from said moldboard, for controlling and maintaining the position of said snow in substantially close proximity with said moldboard;

said arcuate foil means having a front edge and a back edge parallel to each other and parallel to the ground so that the front edge is the same distance from the ground as the back edge;

and the back edge is positioned behind the top margin of the moldboard.

* * * * *